United States Patent [19]

Miolo

[11] 4,299,389

[45] Nov. 10, 1981

[54] MAGNETIC CHESSBOARD WITH SELF-CENTERING PIECES

[76] Inventor: Lino Miolo, Via S. Rocco, 2 Schio, (Vicenza), Italy

[21] Appl. No.: 60,179

[22] Filed: Jul. 24, 1979

[30] Foreign Application Priority Data

Jul. 25, 1978 [IT] Italy ..... 85586 A/78

[51] Int. Cl.[2] ..... A63F 3/01

[52] U.S. Cl. ..... 273/239; 273/260

[58] Field of Search ..... 273/239, 1 M; 46/240

[56] References Cited

U.S. PATENT DOCUMENTS

| | | | |
|---|---|---|---|
| 2,511,774 | 6/1950 | Goldsmith | 273/239 |
| 2,655,379 | 10/1953 | Miller | 273/85 B |
| 3,433,478 | 3/1969 | Span | 46/240 |
| 3,532,341 | 10/1970 | Shaw | 46/240 |

FOREIGN PATENT DOCUMENTS

| | | | |
|---|---|---|---|
| 197711 | 11/1977 | U.S.S.R. | 46/240 |

*Primary Examiner*—Richard C. Pinkham
*Assistant Examiner*—R. Carl Moy
*Attorney, Agent, or Firm*—D. Paul Weaver

[57] ABSTRACT

Each square of a chessboard is centrally provided with a magnet, and each chess and/or draughts piece is provided with a permanent magnet. Because of the presence of the magnets, each piece is automatically centered in the square, toward which it is moved, without requiring any operation of "settling" and of possible taking back of the piece. Furthermore, each piece is secured against shocks or sudden movements of the chessboard.

3 Claims, 3 Drawing Figures

MAGNETIC CHESSBOARD WITH SELF-CENTERING PIECES

BACKGROUND OF THE INVENTION

The present invention refers to a magnetic chessboard with self-centering pieces with respect to the chessboard squares, toward which they are moved.

The difficulties the chess or draughts player has to face when, on occasion of each move, he must try to locate the piece in the center of the selected square, are well known. It easily happens that the piece is placed outside of the center; as a consequence, the player has to center the piece by means of a subsequent step called "j'adoube" ("I settle").

Frequently, by this "settling" step, the taking back of a piece is concealed, to change a move of which the player is not quite happy, and this may lead to remonstrances from the opposing player.

According to the invention, this drawback is eliminated with a magnetic chessboard with self-centering pieces, wherein each square is provided with a magnet embedded in its center, and each chess and/or draughts piece is provided with a permanent magnet embedded inside its base.

Advantageously, the magnet centrally embedded in each square may be of a cylindrical shape with its geometric axis vertically placed and with its magnetic axis radial and horizontally placed. The magnet of each chess piece and/or draughts piece may be of a cylindrical shape with its geometric and magnetic axes coinciding and horizontally placed.

Other features and advantages of the invention will become apparent during the course of the following description.

DETAILED DESCRIPTION

Figure 1:
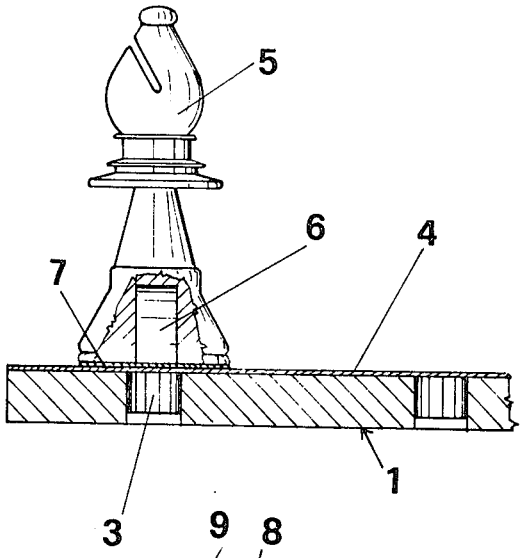
FIG. 1 is a partially cross-sectioned elevational view of a portion of the chessboard according to the invention, with a chess piece thereon.

As shown in the drawings, the chessboard 1 according to the invention comprises for each square 2 a permanent magnet 3, FIG. 1, having a cylindrical shape with a vertical geometric axis and with a magnetic axis coinciding with the geometric one.

The permanent magnet 3 is embedded in a hole grooved in the center of the square 2, the entire chessboard being coated with a thin sheet 4, for instance of a plastic laminated material, which conceals all the magnets 3.

The base of each chess piece 5 is provided with a permanent magnet 6, also of a cylindrical shape with horizontal geometric axis and with radial magnetic axis, vertically placed.

Each chess piece 5 is coated, on its inferior or bottom surface, with a small velvet disc 7 which conceals the magnet 3.

Figure 2:
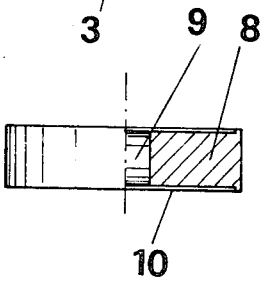
FIG. 2 is a partially cross-sectioned vertical view of a draughts piece.

Likewise, the draughts or checkers piece, FIG. 2, bears at its center a permanent magnet 9, also of a cylindrical shape, with horizontal geometric axis and radial magnetic axis, vertically placed. In this case, the permanent magnet 9 is hidden on both faces by means of an external coating sheet 10.

Figure 3:
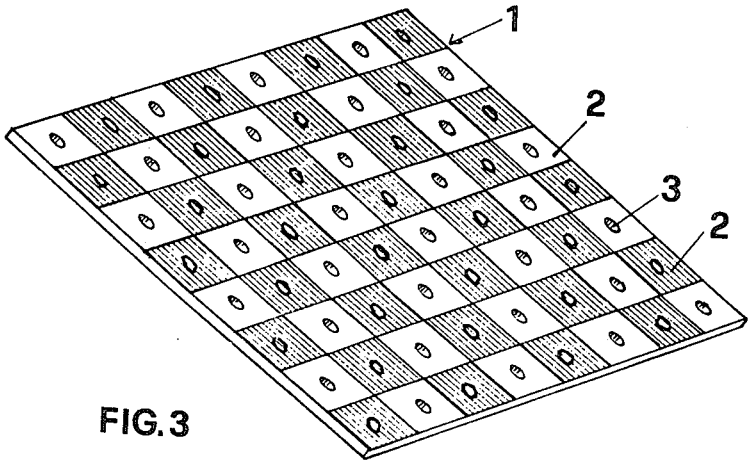
FIG. 3 is a perspective view of the chessboard according to the invention, without a top coating sheet.

The cylindrical magnets 3 are placed, as previously mentioned, at the center of each square 2 of the chessboard 1, FIG. 3, which, seen from outside, appears identical to a traditional chessboard. The same may be said of the chess pieces 5 and of the draughts pieces 8.

The magnetic axes, respectively the radial one of the magnets 6 and 9 embedded in the pieces 5 and 8, and the axial one of the magnet 3 embedded in the chessboard 1, are parallel so as to secure a strong attraction between the two magnets.

The arrangement of the two permanent magnets, with their geometric axes perpendicular to each other, secures a perfect centering of the pieces 5 and 8 with respect to the square 2 as soon as the piece has been brought within the square, even if to an uncentered position.

Furthermore, in the draughts or checkers game, the position of two pieces superposed called "King" becomes firm.

The advantages of the chessboard according to the invention are evident: it allows the self-centering of the pieces 5, 8, as soon as the move has been done. The operation of "settling" is eliminated, as it is no more needed, and so are eliminated the possible consequent taking back of the piece, and the changing of the move. Moreover, the pieces 5, 8 on the chessboard become remarkably stable during the game and cannot be unintentionally displaced, as it might happen, for instance as a consequence of shocks or sudden movements affecting the chessboard or the table on which the chessboard is placed.

Other evident advantages refer to the case in which the chessboard is employed in a moving vehicle, in a plane or in a boat.

In a different embodiment (not shown) of the chessboard according to the invention, a permanent magnet having a vertical geometric axis and a horizontal radial magnetic axis is embedded at the center of each square 2, and a permanent magnet with geometric and magnetic axes horizontal and coinciding is embedded in the base of each piece 5, 8. In this case, each piece is centered and oriented in the square 2.

In a further embodiment of the invention, the permanent magnet embedded at the center of each square and the permanent magnet embedded in the base of each piece have geometric and magnetic axes vertical and coinciding. In this case, the chessboard may be produced in a simpler and more economical way but the centering of the piece in the square is not as precise.

It is also conceivable to use electromagnets rather than magnets, and in this case the centering of the piece in the square is more precise, but the difficulty of producing and using the chessboard is greater due to the electrical feeding required for it.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A magnetic chessboard with self-centering pieces, said chessboard comprising a plurality of squares wherein each said square of the chessboard is provided with a cylindrical permanent magnet embedded in its center, each cylindrical permanent magnet of each square having a vertical geometrical axis and a magnetic axis with the same orientation in all of the squares, and each piece being provided with a cylindrical permanent magnet embedded in its base, each last-named permanent magnet having a geometrical axis parallel to said base and a magnetic axis parallel to the magnetic axes of the magnets of said squares whereby the self centering effect between the board and the pieces in enhanced.

2. A magnetic chessboard as defined in claim 1, and the magnetic axes of the magnets of each square and of each piece being vertical.

3. A magnetic chessboard as defined in claim 1, and the magnetic axes of the magnets of each square and of each piece being horizontal.

* * * * *